United States Patent [19]

Grellet et al.

[11] 4,448,611

[45] May 15, 1984

[54] PROCESS FOR IMPROVING THE CORROSION RESISTANCE OF FERROUS METAL PARTS

[75] Inventors: Bernard Grellet, Saint-Etienne; Jean-Pierre Emmanuel, Cellieu; Bernard Sipp, Andrezieux-Boutheon, all of France

[73] Assignee: Centre Stephanois de Recherches Mecaniques Hydromecanique et Frottement, Andrezieux-Boutheon, France

[21] Appl. No.: 488,612

[22] Filed: Apr. 25, 1983

[30] Foreign Application Priority Data

Apr. 23, 1982 [FR] France ..... 82 07008

[51] Int. Cl.[3] ..... C23F 7/04

[52] U.S. Cl. ..... 148/6.11; 148/15.5

[58] Field of Search ..... 148/6.11, 15.5, 15.00

[56] References Cited

U.S. PATENT DOCUMENTS

| | | | |
|---|---|---|---|
| 2,271,375 | 1/1942 | MacKay | 148/6 |
| 2,479,979 | 8/1949 | Spence | 148/6.11 |
| 2,537,035 | 1/1951 | Clingan | 148/6.11 |
| 3,847,685 | 11/1974 | Baboian | 148/6.11 |
| 3,915,759 | 10/1975 | Smollett | 148/6.11 |
| 4,055,446 | 10/1977 | Kunst et al. | 148/15 |
| 4,292,094 | 9/1981 | Kunst | 148/6.11 |

FOREIGN PATENT DOCUMENTS 761541 11/1956 United Kingdom .

*Primary Examiner*—Sam Silverberg

*Attorney, Agent, or Firm*—Young & Thompson

[57] ABSTRACT

To improve the corrosion resistance of ferrous metal parts containing free or combined sulphur on the surface, the parts are immersed in a bath of molten oxidizing salts at between 350° C. and 450° C., the bath typically having a composition by weight of 60% of potassium hydroxide, 30% of sodium nitrate and 10% of sodium carbonate. Between 0.5% and 15% of oxygen-containing salts, the normal oxidation-reduction potential of which is less than or equal to −1 volt, relative to the hydrogen electrode, such as alkali metal dichromates, permanganates, peroxycarbonates, iodates and periodates, are added to the bath, and an oxygen-containing gas is blown into the bath with an oxygen flow of between 1.5 and 7.5 liters/hour per 100 kg of bath. The molten salts of the bath are filtered continuously through an iron gauze filter cartridge in a furnace, the molten salts being transported into the filter cartridge by entrainment of the salts in a pipe by bubbles of air blown in through the pipe.

20 Claims, 1 Drawing Figure

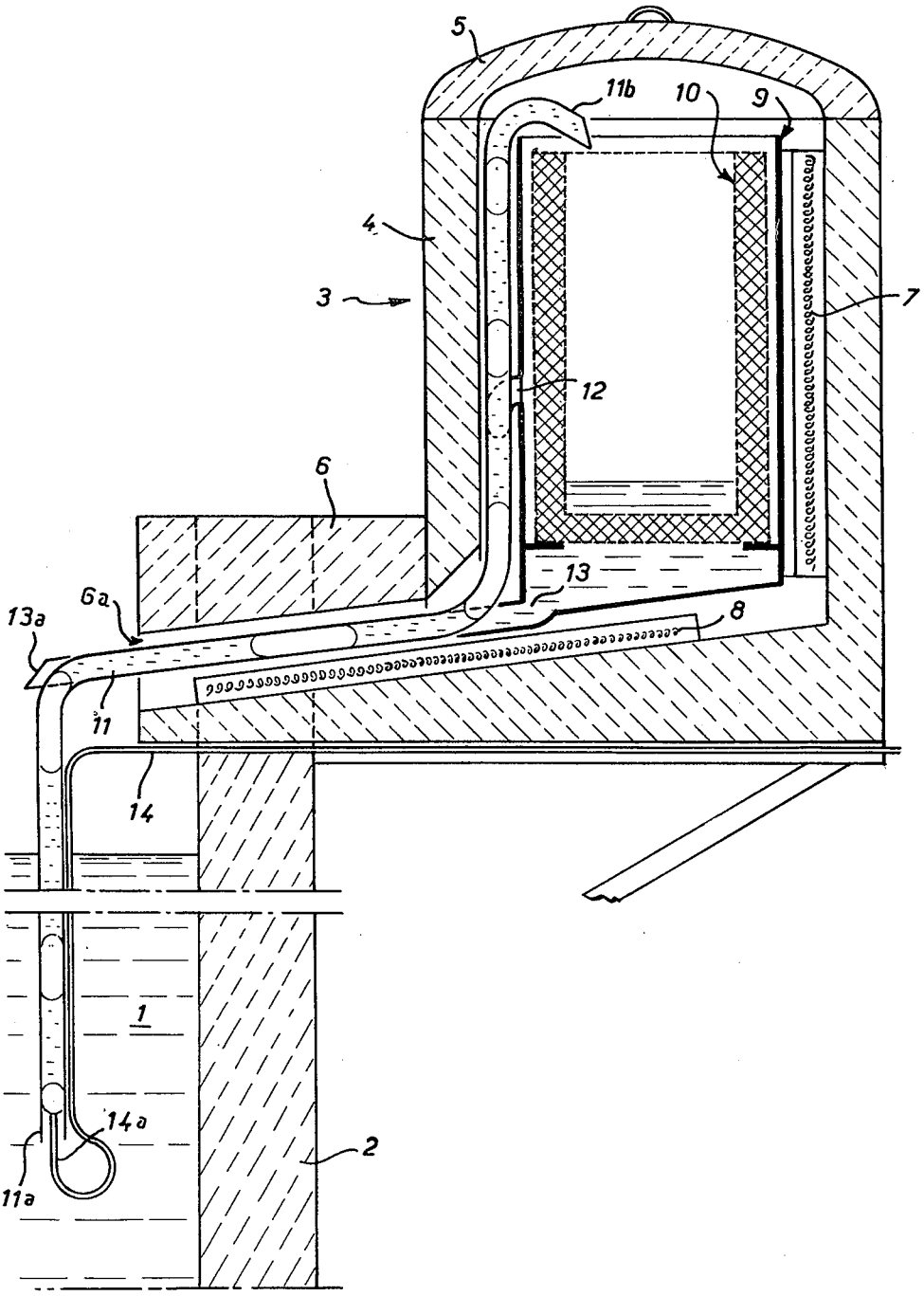
5
11b
10
9
4
3
7
12
6
13
6a
13a
8
11
14
1
14a
2
11a

PROCESS FOR IMPROVING THE CORROSION RESISTANCE OF FERROUS METAL PARTS

This invention relates to a process for improving the corrosion resistance of ferrous metal parts, in which the parts are immersed in an oxidising bath of molten salts, this process being suitable for treating parts containing combined or free sulphur in their surface layers.

The inherent value of processes capable of improving the corrosion resistance of parts is self-evident, in particular if the composition of the parts or the treatments which they have undergone result in the parts having special mechanical properties. In general, an improvement in corrosion resistance is effected either by a continuous coating which is inherently corrosion-resistant, or by the formation of a continuous oxidised layer on the surface (passivisation phenomenon). Coatings which are inherently corrosion-resistant frequently have this property because of the spontaneous formation of an oxidised (passive) layer in contact with the atmosphere; also, certain metals and alloys, used in the solid state for producing parts, resist corrosion for the same reason.

However, both coatings and solid metals and alloys which are inherently corrosion-resistant are expensive, in particular if special mechanical properties of the metal parts are required. The protection of steel by hard chroming, or chrome-nickel steels, if appropriate with added amounts of other rare metals, illustrate this.

There is therefore an interest in treatments for improving the natural corrosion resistance of parts by the growth of a continuous and impermeable oxidised layer on the surface. The oxidation processes depend on the chemical reactivity of the metals in question and on the properties of their oxides, so that the definition of a process is necessarily limited to at least one base metal. In the present invention, the base metal is iron; since ferrous metals, such as irons, cast irons and steels are, by far the most widely used in mechanical engineering.

Processes for the oxidation of ferrous metal parts in order to improve their corrosion resistance have been known for a very long time, for example the bronzing of weapons. Oxidation processes by heating in an oxidising atmosphere or by the action of steam on metal parts, in particular cast iron parts, which are at red heat, have been adopted. These old processes are of limited efficacy and are frequently difficult to control, so that the corrosion resistances obtained have widely varying values.

The use of oxidising salt baths, the composition and temperature of which can be adjusted with precision, leads to improved and reproducible corrosion resistances.

French patent application No. 76 07858, published under No. 2,306,268, describes an oxidising salt bath composed of alkali metal hydroxides, if appropriate with 2 to 20% by weight of an alkali metal nitrate. At preferred operating temperatures in the range 200° C. to 300° C., this salt bath was intended for simultaneously effecting controlled cooling of nitrided ferrous metal parts leaving a cyanate/cyanide nitriding bath, and the destruction, by oxidation, of the cyanides carried by the parts.

According to French patent application No. 80 18401, published under No. 2,463,821, the alkali metal hydroxide bath, containing from 2 to 20% by weight of alkali metal nitrate, gives the nitrided parts a substantially increased corrosion resistance if they are immersed in the bath at between 250° C. and 450° C. for a sufficient period of time between 15 and 50 minutes.

A study of this French patent application No. 80 18401, and in particular of its examples which describe a bath comprising, by weight, 37.4% of sodium hydroxide, 52.6% of potassium hydroxide and 10% of sodium nitrate, shows improvements in resistance to corrosion caused by salt mist, which result in a virtual doubling of the exposure times before traces of corrosion appear.

The examples also show that the immersion temperatures and times of the parts must be adapted to the compositions of the parts treated. It is seen, moreover, that the improvements in corrosion resistance which can be obtained by a treatment in an oxidising salt bath depend primarily on the surface composition of the parts treated; the juxtaposition of chemical species having various oxidation-reduction potentials gives rise to complex redox equilibria in which all the oxidising/reducing pairs can be involved. Furthermore, the chemical species of which the surface layer is composed can be involved in metastable combinations; and the behaviour of these combinations in contact with the oxidising salt bath is frequently of major importance in the process for the formation of the oxidised layer.

The presence of sulphur in the surface layers of ferrous metal parts generally has an unfavourable effect on the corrosion resistance. Inclusions of sulphur, sulphides and oxysulphides form incipient corrosion zones. Free or combined sulphur exists as an impurity in the common construction steels, cast irons and, frequently, sintered irons, It also exists, but as an active additive, in so-called sulphur steels (in particular free-cutting steels). Surface treatments by carbo-nitro-sulphurisation or nitro-sulphurisation, such as those known under the tradenames SULFINUZ and SURSULF, systematically introduce sulphur into the surface layers of the parts treated. It has been found that the conventional oxidising salt baths, containing nitrites and nitrates, are insufficient for reducing the sulphur content in the oxidised layers to values such that the improvements in corrosion resistance are substantial. The reasons for the relative inefficacy of oxidising salt baths relative to sulphur and its compounds are not known with certainty. However, although sulphur combines easily with oxygen, sulphur and oxygen compete in reactions with metals, and numerous metal sulphides or oxysulphides are fairly stable in oxidising media.

The known oxidising salt baths contain alkali metal nitrates and/or nitrites diluted by alkali metal hydroxides, if appropriate containing alkali metal carbonates; the proportion of the various constituents can be adjusted by an expert according to the conditions of use which are envisaged. In particular the temperature of use and to a certain extent the complexity of shape of the parts to be treated, govern especially the viscosity of the composition at the use temperature. Furthermore, the hydroxides are not in themselves oxidising agents, but modify the acid-base reactions which take place between the salts in the bath and the oxides formed on the surface of the parts. Moreover, the dilution of the direct oxidising agents, namely nitrates and nitrites, by the hydroxides and carbonates reduces the explosion risks.

It is a main object of the invention to provide a treatment process in an oxidising salt bath, which substantially improves the corrosion resistance of ferrous metal parts containing sulphur.

BRIEF SUMMARY OF THE INVENTION

The invention provides a process for improving the corrosion resistance of ferrous metal parts containing free or combined sulphur in their surface layers, in which the parts are immersed in an oxidising bath of molten salts comprising alkali metal hydroxides, alkali metal nitrates and/or nitrites and, if appropriate, alkali metal carbonates, comprising adding to the oxidising bath from 0.5% to 15% by weight of oxygen-containing salts of alkali metals, the normal oxidation-reduction potential of which is less than or equal to −1.0 volt relative to the hydrogen reference electrode; blowing a gas containing oxygen into the bath at a sufficient rate for the bath to be saturated with dissolved oxygen; immersing the parts in the bath for a sufficient time for the composition of their surface layer to be stabilised; and maintaining below 3% by weight the proportion of insoluble particles in the bath.

The fundamental discovery which led to the present invention is the fact that the oxidation of free or combined sulphur in the presence of the iron in the parts does not take place to a sufficient degree to be irreversible unless sufficiently powerful oxidising agents are present, that is to say oxidising agents of which the normal oxidation-reduction potential is less than or equal to −1.0 volt, relative to the hydrogen reference electrode, that is to say greater than or equal to an absolute value of 1.0 volt. However, these powerful oxidising salts tend to decompose at the temperatures of use of the baths with formation of oxygen. This tendency to decompose can be reduced by keeping the salt bath in the state of saturation with dissolved oxygen, in other words by keeping to a minimum the redox potential of the pair comprising the powerfully oxidising salt and the oxygen electrode formed by the salt bath itself. Furthermore, the presence of particles suspended in the bath ends to catalyse the decomposition of the powerful oxidising agents.

The oxidising salts which will preferably be used are dichromates, permanganates, peroxycarbonates, iodates and periodates of alkali metals, namely of sodium and potassium.

It has been determined experimentally that, for the oxygen dissolved in the bath to remain at saturation, it is preferred to blow in oxygen-containing gas at a rate suchthat the amount of pure oxygen blown in is 1.5 to 7 litres/hour per 100 kg of bath, under normal temperature and pressure conditions, that is to say 1 to 5 g of oxygen per hour and per 100 kg of bath. Air is suitable as the oxygen-containing gas.

The compositions of salt baths, before the addition of the oxidising salts having a normal oxidation-reduction potential of less than −1 volt, preferably include, by weight, from 25% to 35% of alkali metal nitrates and less than 15% of alkali metal carbonates, the remainder being alkali metal hydroxides, and the alkali metals being, in particular sodium and potassium. The preferred use temperatures range from 350° C. to 450° C.

To keep the proportion by weight of particles below the prescribed limit, it is preferred to circulate the bath continuously, passing it through a filter with an equivalent mesh size of 3 micrometers, that is to say a filter which retains virtually all particles with a size of more than 3 micrometers and the majority of particles with a size of 2 to 3 micrometers.

As a preferred arrangement, the continuous circulation through the filter is caused by entraining the molten salts by the oxygen-containing gas blown in, in order to avoid having to use a mechanical circulating pump, which would work in an aggressive medium.

BRIEF DESCRIPTION OF THE DRAWING

The characteristics and advantages of the invention will be apparent from the following description, which relates to particular embodiments and is provided with examples and which refers to the attached drawing which shows diagrammatically a device for circulating and filtering salt baths.

DETAILED DESCRIPTION

Example 1

Formation of a test bath according to the invention 1,020 grams of potassium hydroxide, 510 grams of sodium nitrate and 170 grams of sodium carbonate are melted in an electrically heated, 1 liter crucible. 85 grams of a mixture of equal parts by weight of potassium permanganate and potassium dichromate, the normal oxidation-reduction potentials of which are less than −1 volt, relative to the hydrogen electrode, are added thereto. The crucible is fitted with an embedded nozzle connected to a pressurised air supply via a flow adjuster valve and a flow meter capable of measuring flows of the order to 0.02 to 0.2 $cm^3/s$. Next to the crucible, there is a sintered iron filter fitted with a heating jacket through which the contents of the crucible are passed periodically. The sintered iron filter is provided in order to retain the particles with a diameter of more than 3 micrometers.

EXAMPLE 2

Treatment of cast iron parts

In the bath of Example 1, which is at a temperature of 400° C.±10° C., a series of cast iron parts containing 0.1% of sulphur is treated, each part remaining in the bath for 30 minutes. The air flow is 0.1 $cm^3/s$ calculated under normal conditions, which corresponds to approximately 0.1 of oxygen per hour and per 1.785 kg of bath.

Every ten operations, the bath is filtered through the sintered iron filter.

When the number of parts passed through the bath is such that the total area of cast iron in contact with the bath has reached 50 $cm^2$, the bath is analysed for the content of sulphur compounds.

The sulphur content is 20 p.p.m., that is 36 mg of sulphur for the whole bath.

For comparison, a control treatment was carried out in which case iron parts were treated in the same way in a bath containing 1,020 grams of potassium hydroxide, 510 grams of sodium nitrate and 170 grams of sodium carbonate. The sulphur content of the bath was only 5 p.p.m. (9 mg of sulphur).

Furthermore, the parts treated in the bath of the invention containing 85 grams of the mixture of potassium dichromate and potassium permanganate were subjected to a standard test for corrosion by salt mist, and the control parts also subjected to this test. On the control parts,apparent traces of corrosion appear after about 35 to 45 hours of exposure. However, the parts treated in the bath containing potassium dichromate and potassium permanganate are virtually unchanged after 150 hours of exposure.

EXAMPLE 3

Treatment of steel parts

The previous test was repeated in an identical manner with steel parts. The sulphur content of the bath according to the invention and of the conventional bath were respectively 5 p.p.m. and 1 p.p.m., that is 9 mg and 2 mg of sulphur. Of course, the steels contain substantially less sulphur than the cast irons.

Similar tests were carried out, varying nitrate or nitrite content of the bath between 25% and 35% by weight, the alkali metal carbonate content between 0 and 15% by weight, the remainder being sodium hydroxide and potassium hydroxide. The parts treated in these baths behave in substantially the same way as the comparison parts of Examples 2 and 3. The amounts of sulphur passed into the bath are comparable.

When between 0.5% and 15% by weight of oxidising alkali metal salts, the normal oxidation-reduction potential of which is less than −1 volt, relative to the hydrogen electrode, is added to these baths, it is found that the amount of sulphur which passes into the bath increases substantially. At the same time, the cast iron parts, which have a considerable sulphur content, show a spectacular gain in corrosion resistance, of the same order as in Example 2. In addition to potassium dichromate and potassium permanganate, the oxidising salts used were peroxycarbonates, iodates and periodates. It was shown that the threshold of −1 volt was significant.

The tests which follow were carried out on parts in a full-size operation in a vat whose interior volume was about 900 liters.

The basic bath contained 900 kg of potassium hydroxide, 450 kg of sodium nitrate and 150 kg of sodium carbonate. 50 kg of potassium permanganate, 50 kg of potassium dichromate and 50 kg of sodium peroxycarbonate were added to this basic bath.

EXAMPLE 4

Treatment of nitrided parts

Ferrous metal parts were nitrided in a salt bath of alkali metal (sodium, potassium and lithium) cyanates/carbonates, with a sulphide as an activator. The composition by weight of the nitriding layer includes about 87% of iron nitride $\epsilon(Fe_{2-3}N)$ and about 10% of iron nitride $\gamma(Fe_4N)$, the remainder being iron oxides, sulphides and oxysulphides of poorly defined composition.

On leaving the nitriding bath, the parts are immersed for 20 minutes in the bath defined above, heated to 420° C.±15° C., into which air is blown at a rate of 420 liters/hour (under normal temperature and pressure conditions). Moreover,the bath is filtered by continuous circulation through a wire gauze filter at a rate of about 100 liters/hour, the equivalent mesh size of the filter corresponding to about 3 micrometers.

After treatment, the nitrided layer of the parts contains $\epsilon$ iron nitride with 6% of $\gamma$ iron nitride, whereas all the oxysulphide compounds have been converted to magnetite iron oxide, with inserted oxygen over the first 2 of 3 micrometers.

The resistance to corrosion caused by salt mist reaches or exceeds 200 to 250 hours. By way of comparison, the nitrided parts not treated in the oxidising bath do not exceed 50 to 60 hours.

Moreover, the performance characteristics in terms of wear resistance and fatigue resistance are not substantially modified by the oxidation treatment, but an improvement is found in the anti-seizing properties, particularly under conditions of dry rubbing.

COMPARISON EXAMPLES

Nitrided parts are treated under the same conditions as in Example 4, except that the supply of air was omitted. The treated parts had a corrosion resistance which did not exceed 100 hours.

Omitting the filtration of the bath led to a drop in corrosion resistance of the treated parts which was similar to that due to stopping the blowing-in of air, when the proportion of insoluble materials in the bath reached 3% by weight.

It will be noted that the cast iron parts cause the formation of a relatively large amount of insoluble materials, because of the presence of graphite and iron sulphide, which come away from the surface layers.

Filtration by continuous circulation assumes that a pump removes the contents from the bath to feed the filter, from which the salts can return under gravity. The whole system must work at the temperature of the salt bath so that the salts are sufficiently fluid. Mechanical pumps which are suitable for providing low and uniform throughputs are rapidly put out of use. The filtration is therefore preferably provided by a set, the arrangement of which is shown in the figure.

The arrangement shown comprises the salt bath 1 with a refractory wall 2 lined with a metal skin. The filtering device comprises a furnace 3 of cylindrical general shape, with a refractory lining 4 and a cover 5, resting on a refractory plinth 6 bracketed on the wall 2. The furnace 3 has lateral heating elements 7. A channel **6*a* in the plinth 6 slopes towards the salt bath 1 and communicates with the interior of the furnace 3. this channel 6*a* has a half heating element 8**.

The furnace 3 is fitted with a metal filter chamber 9 in which there is a tubular filtering element 10 made of iron gauze with a bottom. The bottom of the filter chamber 9 is fitted with a discharge nozzle 13 which passes along the channel **6*a* and terminates in a discharge spout 13*a*. The chamber is also fitted with an overflow nozzle 12 half-way up the chamber 9**.

A mild steel pipe 11, with an internal diameter of 22 mm, extends vertically from one end **11*a* inside the bath 1, bends to pass along the channel 6*a*, and then rises vertically in the furnace 3 between the refractory lining 4 and the chamber 9 to terminate in a spout 11*b* above the filter 10. A compressed air inlet pipe 14 made of mild steel, with a diameter of 8 mm and fitted with a flow adjuster valve and a relief valve neither of which are shown, passes underneath the plinth 6 and is attached to the vertical part of the pipe 11 and immersed in the bath 1. The end part 14*a* of the pipe 14 is shaped in a loop so that it enters the end 11*a* of the pipe 11** substantially coaxially.

When compressed air is admitted into the pipe 14 at an adjusted rate, this air escapes through the end **14*a* to form a bubble, the limiting volume of which corresponds to the equilibrium between the rising force of the bubble and the surface tension force of the bath on the periphery of the pipe 14*a*. The successive bubbles rise up the tube 11, pushing before them the molten salts trapped between two successive bubbles. When the effective height of the column of salt bath in the pipe 11 is less than the depth to which the end 11*a* of the pipe 11 is immersed in the bath 1, the molten salts can discharge through the spout 11*b* into the filter 10. The expression "effective height of the column" is understood as meaning the height effectively occupied by molten salts, the height of the bubbles being subtracted from the total height separating the ends 11***a* and 11*b*. The molten salts tend to trickle along the wall of the pipe 11 under gravity, flowing at a rate depending on the viscosity of the salt bath, so that, for very slow air flows, the amount of molten salts entrained is reduced to zero. On the other hand, if the air flow is excessive, separate bubbles are no longer formed and the pumping is also ineffective. However, for air flows of between 1.5 and 4 liters/minute, salt flows of between 1 and 8 liters/minute can be obtained.

The salts discharged into the filter 10 pass through it, leaving the solid particles behind on the internal wall, and collect together in the lower part of the chamber 9 to flow through the tube 13 and return to the bath 1. In the event of clogging of the filter 10, the salts will overflow into the chamber 9 around the filter 10, and will be discharged through the overflow 12. The appearance of salt flowing through the overflow 12 will indicate that the filter is clogged.

Because the filtering device with air entrainment does not comprise moving parts rubbing against one another, the reliability of the filtering device is satisfactory. Moreover, the injection of pumping air contributes towards the oxygenation of the bath by blowing.

I claim:

1. A process for improving the corrosion resistance of ferrous metal parts containing free or combined sulphur in their surface layers, in which the parts are immersed in an oxidising bath of molten salts comprising alkali metal hydroxides, alkali metal nitrates and/or nitrites and, if appropriate, alkali metal carbonates, comprising adding to the oxidising bath from 0.5% to 15% by weight of oxygen-containing salts of alkali metals, the normal oxidation-reduction potential of which is less than or equal to −1.0 volt relative to the hydrogen reference electrode; blowing a gas containing oxygen into the bath at a sufficient rate for the bath to be saturated with dissolved oxygen; immersing the parts in the bath for a sufficient time for the composition of their surface layer to be stabilised; and maintaining below 3% by weight the proportion of insoluble particles in the bath thereby eliminating sulphur contaminants from the said surface layers.

2. A process according to claim 1, wherein that the said oxygen-containing salts of alkali metals are selected from the group comprising dichromates, permanganates, peroxycarbonates, iodates and periodates, the alkali metals being sodium and potassium.

3. A process according to claim 1, wherein the said gas containing oxygen is blown into the bath at a rate such that the flow of pure oxygen is between 1.5 and 7 liters per hour and per 100 kg of bath, measured under normal temperature and pressure conditions.

4. A process according to claim 3, wherein the oxygen-containing gas is air.

5. A process according to claim 1, wherein the oxidising bath comprises, by weight, 25% to 35% of alkali metal nitrates and less than 15% of alkali metal carbonates, the remainder being alkali metal hydroxides and the alkali metal being sodium and potassium.

6. A process according to claim 1, wherein the temperature of the bath is between 350° C. and 450° C.

7. A process according to claim 1, wherein the proportion of insoluble particles in the bath is maintained below 3% by weight by continuous circulation of the molten salts though a filter with an equivalent mesh size of 3 micrometers.

8. A process according to claim 7, comprising continuously circulating the molten salts through the filter by entraining the molten salts by bubbles of the oxygen-containing gas in a rising pipe.

9. A process for improving the corrosion resistance of ferrous metal parts containing free or combined sulphur in their surface layers, in which the parts are immersed in an oxidising bath of molten salts comprising alkali metal hydroxides, alkali metal nitrates and/or nitrites and, if appropriate, alkali metal carbonates, comprising adding to the oxidising bath from 0.5% to 15% by weight of oxygen-containing salts of alkali metals selected from the group comprising dichromates, permanganates, peroxycarbonates, iodates and periodates, the alkali metals being sodium and potassium, the normal oxidation-reduction potential of which salts is less than or equal to −1.0 volt relative to the hydrogen reference electrode; blowing a gas containing oxygen into the bath at a rate such that the flow of pure oxygen is between 1.5 and 7 liters per hour and per 100 kg of bath measured under normal temperature and pressure conditions, whereby the bath is saturated with dissolved oxygen; immersing the parts in the bath for a sufficient time for the composition of their surface layer to be stabilised; and maintaining below 3% by weight the proportion of insoluble particles in the bath thereby eliminating sulphur contaminants from the said surface layers.

10. A process according to claim 9, wherein the oxygen-containing gas is air.

11. A process according to claim 10, wherein the temperature of the bath is between 350° C. and 450° C.

12. A process according to claim 11, wherein the proportion of insoluble particles in the bath is maintained below 3% by weight by continuous circulation of the molten salts through a filter with an equivalent mesh size of 3 micrometres.

13. A process according to claim 12, comprising continuously circulating the molten salts through the filter by entraining the molten salts by bubbles of the oxygen-containing gas in a rising pipe.

14. A process for improving the corrosion resistance of ferrous metal parts containing free or combined sulphur in their surface layers, in which the parts are immersed in an oxidising bath of molten salts comprising, by weight, 25% to 35% of alkali metal nitrates and less than 15% of alkali metal carbonates, the remainder being alkali metal hydroxides and the alkali metals being sodium and potassium; comprising adding to the oxidising bath from 0.5% to 15% by weight of oxygen-containing salts of alkali metals selected from the group comprising dichromates, permanganates, peroxycarbonates, iodates and periodates, the alkali metals being sodium and potassium, the normal oxidation-reduction potential of which salts is less than or equal to −1.0 volt relative to the hydrogen reference electrode; blowing a gas containing oxygen into the bath at a rate such that the flow of pure oxygen is between 1.5 and 7 liters per hour and per 100 kg of bath measured under normal temperature and pressure conditions, whereby the bath is saturated with dissolved oxygen; immersing the parts in the bath for a sufficient time for the composition of their surface layer to be stabilised; and maintaining below 3% by weight the proportion of insoluble particles in the bath thereby eliminating sulphur contaminants from the said surface layers.

15. A process according to claim 14, wherein the said oxygen-containing salts of alkali metals are selected from the group comprising dichromates, permanganates, peroxycarbonates, iodates and periodates, the alkali metals being sodium and potassium.

16. A process according to claim 14, wherein the said gas containing oxygen is blown into the bath at a rate such that the flow of pure oxygen is between 1.5 and 7 liters per hour and per 100 kg of bath, measured under normal temperature and pressure conditions.

17. A process according to claim 16, wherein the oxygen-containing gas is air.

18. A process according to claim 14, wherein the temperature of the bath is between 350° C. and 450° C.

19. A process according to claim 14, wherein the proportion of insoluble particles in the bath is maintained below 3% by weight by continuous circulation of the molten salts through a filter with an equivalent mesh size of 3 micrometers.

20. A process according to claim 14, comprising continuously circulating the molten salts through the filter be entraining the molten salts by bubbles of the oxygen-containing gas in a rising pipe.

* * * * *